US008069510B2

(12) United States Patent
Jansen

(10) Patent No.: US 8,069,510 B2
(45) Date of Patent: Dec. 6, 2011

(54) SPRING SYSTEM FOR UPHOLSTERY, MATTRESSES OR THE LIKE

(75) Inventor: Klaus Jansen, Buxtehude (DE)

(73) Assignee: Thomas Hilfen Hilbeg GmbH & Co. KG, Bremerhaven (DE)

( * ) Notice: Subject to any disclaimer, the term of this patent is extended or adjusted under 35 U.S.C. 154(b) by 945 days.

(21) Appl. No.: 12/063,731

(22) PCT Filed: Aug. 12, 2006

(86) PCT No.: PCT/EP2006/008006

§ 371 (c)(1),
(2), (4) Date: Feb. 13, 2008

(87) PCT Pub. No.: WO2007/020032

PCT Pub. Date: Feb. 22, 2007

(65) Prior Publication Data

US 2010/0270717 A1 Oct. 28, 2010

(30) Foreign Application Priority Data

Aug. 18, 2005 (DE) ..... 10 2005 039 432
Jul. 11, 2006 (DE) ..... 10 2006 031 999

(51) Int. Cl.
*A47C 23/06* (2006.01)

(52) U.S. Cl. ..... 5/238; 5/236.1; 5/239; 5/241

(58) Field of Classification Search ..... 5/236.1, 5/238, 239, 241–244, 719; 297/452.63
See application file for complete search history.

(56) References Cited

U.S. PATENT DOCUMENTS

| | | | | |
|---|---|---|---|---|
| RE3,311 | E * | 2/1869 | Manuel | 5/242 |
| 144,688 | A | 11/1873 | McGill | |
| 151,665 | A | 6/1874 | Hopping | |
| 162,631 | A | 4/1875 | Dodge | |
| 162,680 | A * | 4/1875 | Newman | 5/242 |
| 187,229 | A | 2/1877 | Kendrick | |
| 215,981 | A | 5/1879 | Segar | |
| 4,033,567 | A * | 7/1977 | Lipfert | 267/151 |
| 4,190,914 | A * | 3/1980 | Diallo | 5/247 |
| 5,282,285 | A * | 2/1994 | de Gelis et al. | 5/237 |
| 6,701,550 | B2 * | 3/2004 | Baeriswyl | 5/236.1 |
| 6,718,575 | B1 * | 4/2004 | Lubeck et al. | 5/236.1 |
| 7,621,004 | B2 * | 11/2009 | Lobry et al. | 5/238 |

FOREIGN PATENT DOCUMENTS

| | | | |
|---|---|---|---|
| DE | 20318336 | U1 | 2/2004 |
| DE | 202004010852 | U1 | 11/2004 |
| EP | 0539644 | A1 | 5/1993 |
| FR | 2832042 | A1 | 5/2003 |

* cited by examiner

*Primary Examiner* — Michael Trettel
(74) *Attorney, Agent, or Firm* — Laurence P. Colton; Smith Risley Tempel Santos LLC

(57) ABSTRACT

A spring system in particular for upholstery and/or mattresses of push-carriage seats, furniture for sitting on or lying on or the like, having a plurality of successively spaced-apart slats (20), in particular resilient slats, and having supporting bodies (21) for supporting the slats directly or indirectly on a carrying structure. The bearing points or bearing regions (27) of the slats (20), in which the slats (20) are supported by the supporting bodies (21), are arranged exclusively between the slat ends (31, 32).

21 Claims, 4 Drawing Sheets

SPRING SYSTEM FOR UPHOLSTERY, MATTRESSES OR THE LIKE

STATEMENT OF RELATED APPLICATIONS

This application is the U.S. National Phase Under Chapter II of the Patent Cooperation Treaty (PCT) of PCT International Application No. PCT/EP2006/008006 having an International Filing Date of 12 Aug. 2006, which claims priority on German Patent Application Nos. 10 2005 039 432.9 having a filing date of 18 Aug. 2005 and 10 2006 031 999.0 having a filing date of 11 Jul. 2006.

BACKGROUND OF THE INVENTION

1. Technical Field

The invention relates to a spring system, in particular for upholstery and/or mattresses of push-carriage seats, furniture for sitting on or lying on or the like, having a plurality of successively spaced-apart slats, in particular resilient slats, and having supporting bodies for supporting the slats directly or indirectly on a carrying structure.

2. Related Art

Push-carriage seats and furniture for sitting on or lying on usually have a spring system comprising a so-called slatted base. The slatted base of the spring system has a plurality of slats, in particular resilient slats, located one beside the other at parallel spacings. The resilient slats are usually connected by supporting bodies to longitudinal members of a rectangular frame, which is part of the spring system. Various embodiments of supporting bodies are known in the prior art. In all of these embodiments, the ends of the resilient slats, arranged on opposite sides, are supported on the frame by the supporting bodies. This type of support results in the slat ends being secured in spatial terms, but at least in the movement capability of the slat ends being restricted to a considerable extent. Furthermore, an external frame, on the longitudinal members of which the slat ends are supported, is necessary in each case.

BRIEF SUMMARY OF THE INVENTION

The object of the present invention is, in particular, to provide a spring system for upholstery and/or mattresses of push-carriage seats, furniture for sitting on or lying on or the like, in which there is no longer any need for an external frame for supporting the resilient-slat ends and/or good movement capability of the slat ends is made possible.

A spring system for achieving this object is a spring system, in particular for upholstery and/or mattresses of push-carriage seats, furniture for sitting on or lying on or the like, having a plurality of successively spaced-apart slats, in particular resilient slats, and having supporting bodies for supporting the slats directly or indirectly on a carrying structure, characterized in that the bearing points or bearing regions of the slats, in which the slats are supported by the supporting bodies, are arranged exclusively between the slat ends.

Since the bearing regions or bearing points, in which the slats are supported by the supporting bodies, rather than being arranged on the slat ends arranged on opposite sides, are arranged exclusively between these slat ends, i.e. at a distance from the slat ends, it is possible to dispense with an external frame for supporting the supporting bodies. The slats are supported by the supporting bodies here preferably such that the slat ends can be moved in at least one plane, preferably a plurality of planes, running at an angle to the slat plane. Since the slat ends, in the case of the present invention, are thus not secured directly in spatial terms, they are capable of movement, even if the supporting bodies do not have any resilient properties. That is to say, even if only the slats have resilient properties, a certain movement capability of the slat ends is achieved according to the invention.

It is particularly preferred, however, for the supporting bodies to be wholly or at least partially resilient, this providing better assistance, in relation to the prior art, to the movement of a user whose is resting against upholstery or lying on a mattress supported by the spring system according to the invention. The movement capability of the slat ends provides for particularly good adaptability of the spring system to the contour of a user's body.

The bearing points or bearing regions, in which the slats are supported by the supporting bodies, are preferably spaced apart from the respectively adjacent slat ends by at least 3 cm, preferably at least 5 cm, particularly preferably at least 10 cm, in order to make possible the best possible movement capability of the slat ends. In relation to the slat length, the distance of the bearing regions from the respectively adjacent slat ends may alternatively be at least ⅙ to ⅕ of the slat length.

Each slat is assigned at least two bearing regions or bearing points, which are arranged in a mirror-symmetrical manner in relation to the respective slat center. In a particular embodiment, those bearing regions or bearing points in which preferably directly successive slats are supported by supporting bodies are spaced apart in each case by the same distance from the respective slat center, in which case these bearing regions or bearing points form an at least more or less rectilinear longitudinal row in particular in the direction transverse to the slats. It is possible here for the supporting bodies of a longitudinal row to be arranged on a longitudinal carrier of the carrying structure of the spring system, the longitudinal carrier running, in particular, transversely to the slats. As seen in a plan view of the spring system, the longitudinal carriers are advantageously arranged between the slat ends.

As far as the supporting bodies are concerned, they can thus be fastened on the slats by means of a snap-in connection. The position of the supporting bodies, which support the slats, can preferably be changed relative to the respective slat in order to allow particularly good adaptability of the spring system to individual contours of users' bodies. In a desired position of the supporting bodies, the latter can advantageously be secured individually or jointly by arresting means in their respective position in relation to the slat.

In a preferred embodiment, at least one, preferably all, of the slats, is/are assigned stimulation elements for the basal stimulation of a user who is leaning on the spring system—indirectly via upholstery or a mattress—or of a user who is lying or sitting on the spring system. The stimulation elements are preferably designed as resilient wing elements which have supporting surfaces above the slat plane for resiliently supporting upholstery, a mattress or the like.

The slats, preferably the slat ends, have arranged on them lateral guide elements which are designed such that a lateral movement of upholstery, mattresses or the like butting against the spring system is limited and/or prevented. There is therefore no need for any additional external frame in order to prevent undesirable lateral movement or slipping of the mattress or of the upholstery. Furthermore, provision may be made to fasten the upholstery, the mattress or the like directly on these lateral guide elements. The lateral guide elements expediently have guide surfaces which run perpendicularly to the slat plane and butt laterally against the mattress or the upholstery. The upholstery or the mattress is thus arranged between the lateral guide elements. It is advantageously possible to change the position of the lateral guide elements relative to the longitudinal slat direction, in which case either upholstery or mattresses of different widths can be used or a certain amount of lateral movement of the same may be permitted. The lateral guide elements may be formed by wing elements which can be tilted wholly or partially relative to the slat plane.

In a particular embodiment, a knitted fabric, in particular a three-dimensional knitted fabric, may be positioned on the slats and is connected thereto preferably by a snap-in connection, in particular clamping or clip profiles. Such a knitted fabric can effectively reduce the interspaces between the individual slats in order to provide, for example, upholstery with a good bearing surface without it being necessary for the individual slats to be placed in position with narrower spacings.

BRIEF DESCRIPTION OF THE DRAWING FIGURES

Further features of the invention can be gathered from the subclaims, from the following description of a preferred exemplary embodiment and from the accompanying drawings, in which:

DETAILED DESCRIPTION OF PREFERRED EMBODIMENTS

Figure 1:
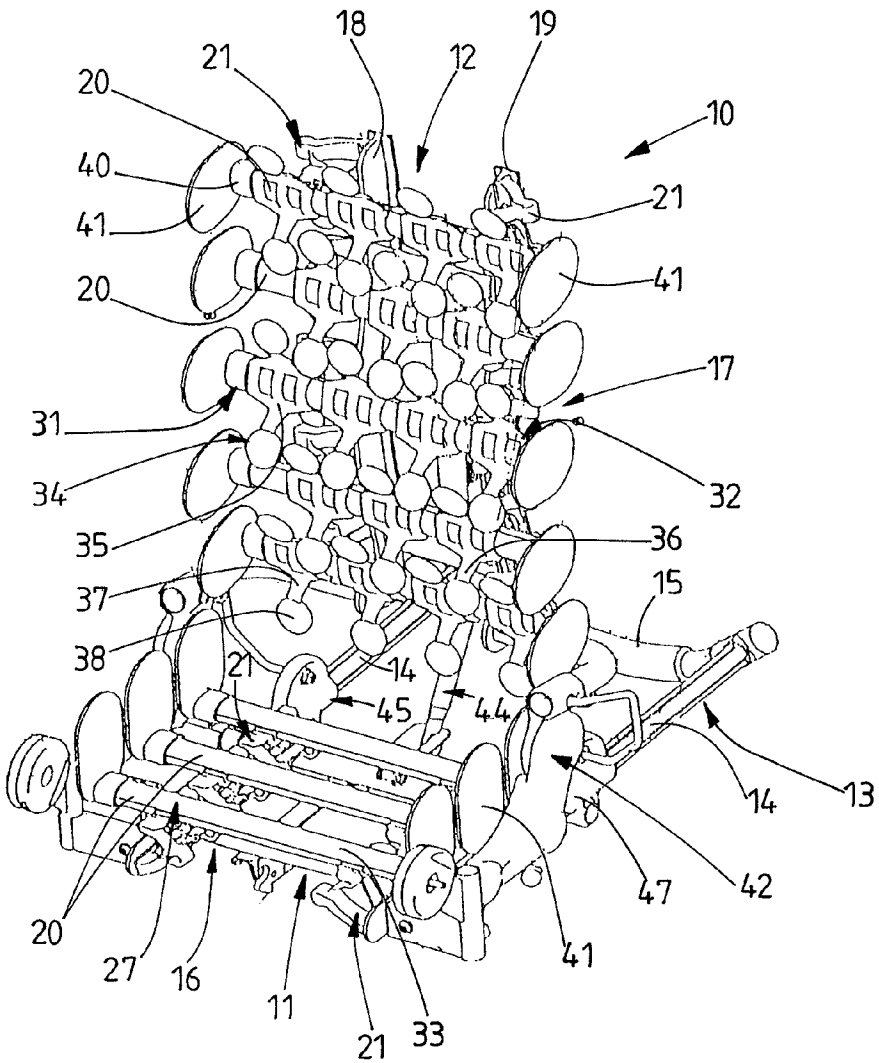
FIG. 1 shows a schematic illustration, in perspective, of a push-carriage seat with a spring system according to the invention.

The spring system according to the invention will be explained with reference to a push-carriage seat 10, which may be part of a stroller or of a means of transporting disabled children or young people. The use of the spring system, of course, is not restricted to push-carriage seats. It may be used, for example, as a spring system for mattresses of a bed and as a spring system for upholstered furniture or the like.

The push-carriage seat 10 is fastened in a releasable manner on a chassis (not illustrated). The seat 10 here has a horizontal seat surface 11 and a backrest 12 which runs at an angle to the seat surface and can be adjusted in inclination in relation to the seat surface 11. The seat surface 11 and backrest 12 form a common structure which is mounted such that it can be displaced, in a manner which will not be explained in specific detail, on a substructure 13 made of two parallel guide rails 14 and a crossmember 15 which connects the rails at their ends.

As will be described hereinbelow, both the seat surface 11 and the backrest 12 have respective spring systems 16 and 17 according to the invention.

The spring system 17 of the backrest 12 has two longitudinal profiles or longitudinal carriers 18, 19, which run parallel to one another and, as carrying structure, form part of the spring system 17. Of course, a large number of other embodiments of carrying structures are also conceivable within the context of the invention without departing from the concept according to the invention. The longitudinal carriers 18, 19 have connected to them slats 20, in particular resilient slats, which run transversely to the longitudinal carriers and follow one after the other from top to bottom. A backrest cushion (not illustrated) is positioned on these slats 20 during use.

The longitudinal carriers 18, 19 are connected to the slats 20, in turn, via supporting bodies 21. For this purpose, starting from a base 22, the supporting bodies 21 each have two supporting-body arms 23, 24 which extend in the direction of the respective slat 20 and are connected to one another at the ends via a transverse profile 25. The transverse profile 25 has a supporting or bearing portion 26 which is curved in the direction of the supporting-body base 22, extends in the longitudinal direction of the slat 20 and has its curvature adapted to the outer curvature of the slat 20. The respective slat 20 butts against this supporting portion 26 by way of a region or portion 27 of its underside 28. The slat 20 is thus supported by the supporting body 21 in its region 27 which butts against the supporting portion 26.

The slat 20 is supported in captive fashion on the supporting portion 26, i.e. the situation where the slat 20 is undesirably displaced or drops out of the spring system 17 is prevented. For this purpose, the transverse profile 25 has protrusions 29 on opposite sides. The protrusions 29 engage in grooves 30 which are arranged on the longitudinal sides of the slat 20 and run in the longitudinal slat direction. Since both the supporting-body arms 23, 24 and the supporting portion 26 are elastic, it is possible for the slat 20, as the spring system 17 is assembled, to engage in the protrusions 29 and be connected to the supporting bodies 21 in the manner of a snap-in connection, i.e. as a result, the slats 20 are clamped on the supporting bodies 21. The bases 22 of the supporting bodies 21 are fastened on the longitudinal carriers 18, 19 in particular are screwed thereto.

As a result of the particular construction of the backrest spring system 17, the bearing regions, in which the respective slats 20 are supported by the supporting portions 26 of the supporting bodies 21, are arranged in each case between the ends 31, 32 of the slats 20. The slat ends 31, 32 are thus unsupported.

Stimulation elements 34 for the basal stimulation of a user who is leaning on the spring system 17 are distributed in the longitudinal direction over the top side 33 of each slat 20. The stimulation elements 34 are designed as wing-like elements which are clamped on the slats. The wing elements 34 have an upwardly curved abutment surface 35, which butts against the top side 33 of the slats 20. Starting from this abutment surface 35, two wing arms 36, 37 with supporting plates 38 at the ends extend upward in relation to the slat plane, i.e. in the direction of a cushion (not illustrated) of the backrest 12. The supporting plates 38 run slightly obliquely in relation to the slat plane. The wing arms 36, 37 here are elastic, in which case they additionally provide resilient support for the backrest 12. Correspondingly, when first placed in position on the backrest 12, the cushion would initially rest on the supporting plates 38 of the wing arms 36, 37. However, the loading of the cushion during use and/or the weight of the cushion itself causes these plates to bend in the direction of the slat plane, in which case the cushion butts both against the supporting plates 38 of the wing arms 36, 37 and against the slats 20. The supporting plates 38, which run obliquely in relation to the slat plane when they are not subjected to loading, run more or less parallel to this plane when they are subjected to loading. The wing elements 34 are designed such that they can be displaced in the longitudinal slat direction.

Since the slat ends 31, 32 are unsupported and the supporting bodies 21, furthermore, are elastic, the spring system 17 of the backrest 12 has particular torsional properties. In particular if the slats 20 are produced from suitable resilient material, on account of the freedom of movement thereof— depending on the loading to which they are subjected by a user leaning on the backrest—the slat ends 31, 32 can move out of the slat plane in the upward, downward or lateral direction or, if appropriate, even about the longitudinal slat axis.

Lateral guide elements 39 are arranged in each case at the ends 30, 31 of each slat 20. The lateral guide element 39 has a cap-like portion 40 by means of which it is plugged onto the respective slat end 30, 31. The lateral guide element 39 also has a more or less oval guide surface, namely a plate 41, which runs perpendicularly in relation to the slat 20. This oval plate 41 serves to limit lateral movements of the cushion (not illustrated), which is arranged between the plates 41, in the longitudinal slat direction and/or to prevent lateral movements. The lateral guide elements 39 may be designed such that it is possible to change the position thereof—within limits—relative to the slat in the longitudinal slat direction.

Figure 3:
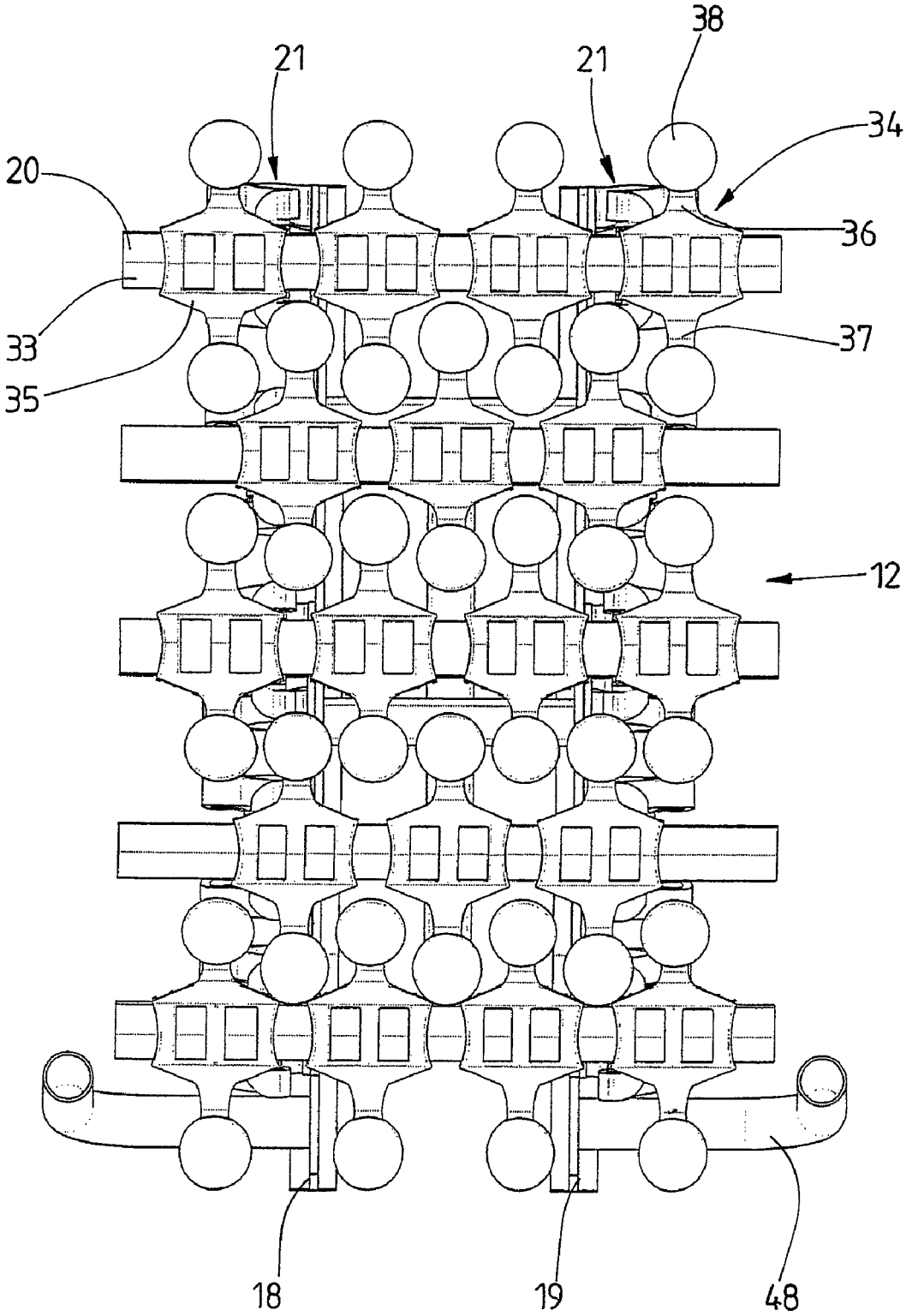
FIG. 3 shows a plan view of a detail of the backrest of the push carriage.

As can be seen, in particular, in FIGS. 1 and 3, the bearing regions 27 of successive slats 30, that is to say those regions in which the slats 20 are supported by the supporting portions 26, are each arranged in a mirror-symmetrical manner in relation to the corresponding slat center. Accordingly, in relation to the respective slat center, supporting portions 26 are arranged on respectively opposite sides of the slats 20, as seen in the longitudinal slat direction, at identical distances from the slat center.

Figure 2:
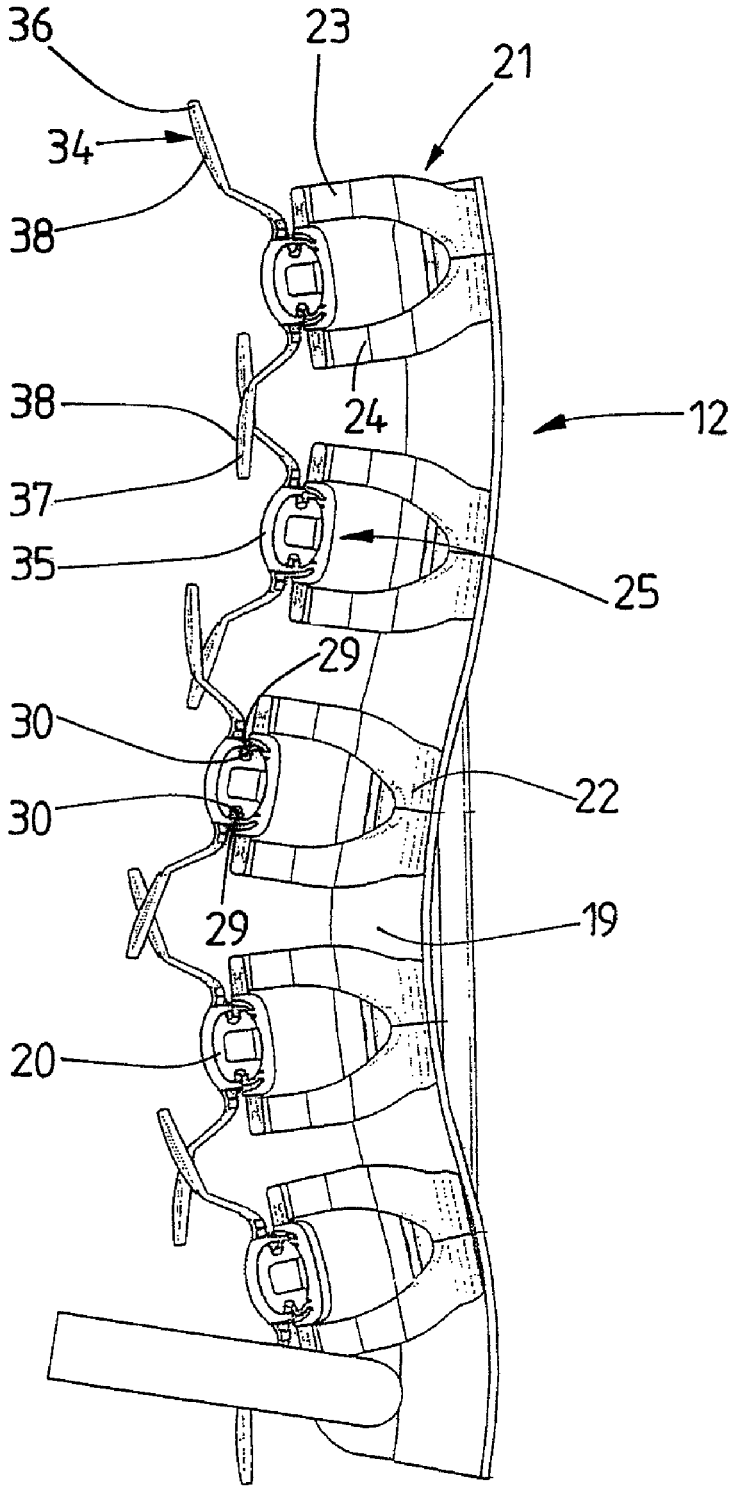
FIG. 2 shows a longitudinal section through the backrest of the push carriage according to FIG. 1.

Furthermore, as can be seen, in particular, in FIG. 2, the backrest 12 is curved slightly in longitudinal section and is thus adapted to the contours of a user's body.

The backrest 12 is connected in a pivotable manner to the seat surface 11. For this purpose, a profile tube 33, which is connected to the longitudinal carriers 16 and has two angled arms 35, is articulated on the seat surface 11 such that it can be pivoted, in a manner which will not be explained in specific detail, via tilting bearings 42, 43. The respective inclination of the backrest 12 can be adjusted via an inclination adjuster 44, which is similarly not illustrated in specific detail.

The spring system 16 of the seat surface 11 (FIGS. 4 and 5) is largely identical to the spring system 17 of the backrest 12. In particular, the spring system 16, in a manner similar to the spring system 17, has slats 20 which are supported by means of supporting bodies 21 between the slat ends 31, 32. The supporting bodies 21 of the seat surface 11 are identical to the supporting bodies 21 of the backrest 12. It is also the case that the slats 20 of the seat surface 11 are supported in regions 27, which are arranged between the slat ends 31, 32, in which case these ends 31, 32 are unsupported.

The bases 22 of the supporting bodies 21 of the seat surface 11 are each connected to longitudinal slats 45 running in the longitudinal seat-surface direction. Arranged on these longitudinal slats 45, in turn, are transverse profiles 46 which run perpendicularly in relation to the same. The seat surface 11 is connected to sleeve-like base parts 47 arranged on opposite sides. The sleeve-like base parts 47 are supported in a displaceable manner in the guide rails 14 of the push-carriage seat 10 for the purpose of adjusting the position of the push-carriage seat 10 relative to the push carriage (not illustrated).

Figure 4:
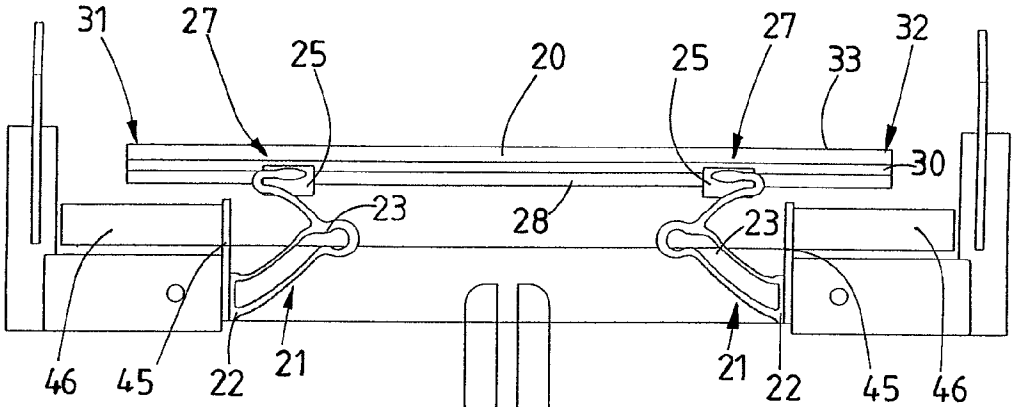
FIG. 4 shows a schematic cross section through the seat surface of the push carriage with a spring system according to the invention.
Figure 5:
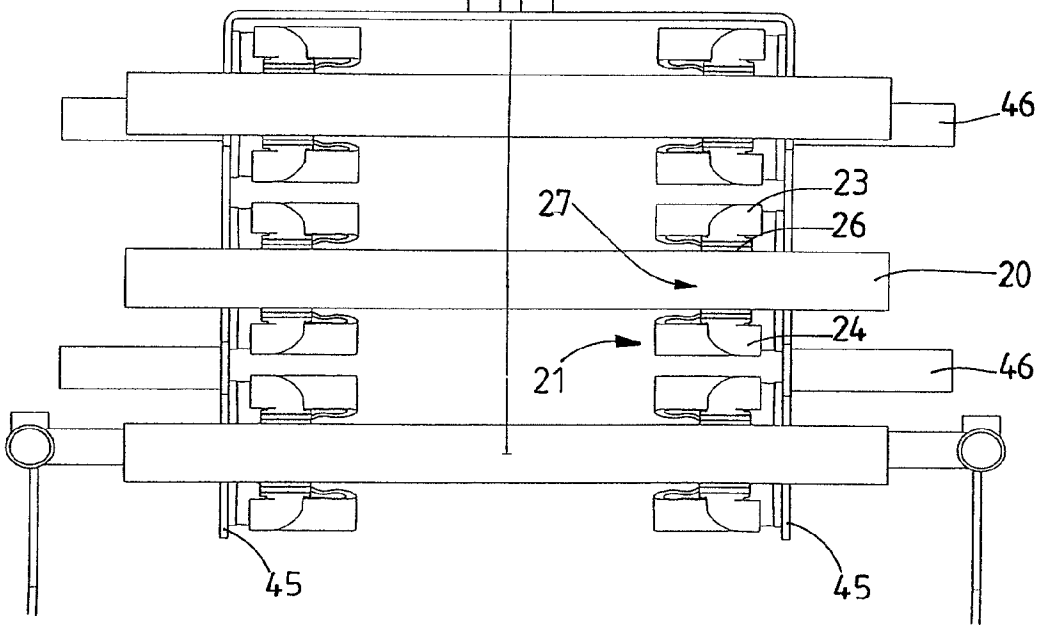
FIG. 5 shows a schematic plan view of the seat surface from FIG. 4.

It should be pointed out that, for the sake of simplicity, the lateral guide elements 39 at the ends 31, 32 of the slats 20 of the seat surface 11 have been omitted from FIGS. 4 and 5.

LIST OF REFERENCE NUMBERS

10 Push-carriage seat
11 Seat surface
12 Backrest
13 Substructure
14 Guide rail
15 Crossmember
16 Seat-surface spring system
17 Backrest spring system
18 Longitudinal carrier
19 Longitudinal carrier
20 Slats
21 Supporting body
22 Supporting-body base
23 Supporting-body arm
24 Supporting-body arm
25 Transverse profile
26 Supporting portion
27 Bearing region
28 Slat underside
29 Protrusions
30 Slat groove
31 Slat end
32 Slat end
33 Slat top side
34 Wing element
35 Abutment surface
36 Wing arm
37 Wing arm
38 Supporting plate
39 Limiting profile
40 Lug-like portion
41 Plate
42 Tilting bearing
43 Tilting bearing
44 Inclination adjuster
45 Longitudinal slats
46 Transverse profile
47 Sleeve-like base part

What is claimed is:

1. A spring system for upholstery and/or mattresses of push-carriage seats, furniture for sitting on or lying on, the spring system having a plurality of successively spaced-apart resilient slats (20) and having supporting bodies (21) for supporting the slats directly or indirectly on a carrying structure, wherein bearing points or bearing regions (27) of the slats (20), on which the slats (20) are supported by the supporting bodies (21), are arranged exclusively between the slat ends (31, 32), wherein the supporting bodies (21) are clamped on the slats (20) by a snap-in connection.

2. The spring system as claimed in claim 1, wherein the slats (20) are supported by the supporting bodies (21) such that the slat ends (31, 32) can be moved in at least one plane running at an angle to a slat plane.

3. The spring system as claimed in claim 1, wherein the bearing points or bearing regions (27), on which the slats (20) are supported by the supporting bodies (31), are spaced apart from the slat ends (31, 32) by at least 3 cm.

4. The spring system as claimed in claim 1, wherein the supporting bodies (21) are wholly or partially resilient.

5. The spring system as claimed in claim 1, wherein each slat (20) is assigned at least two bearing points or bearing regions (27).

6. The spring system as claimed in claim 5, wherein in each case two bearing regions (27) or bearing points of the slat (20) are arranged in a mirror-symmetrical manner in relation to the slat center.

7. The spring system as claimed in claim 1, wherein those bearing regions (27) or bearing points in which directly successive slats (20) are supported by the supporting bodies (21) are spaced apart in each case by the same distance from the respective slat center, in which case those bearing regions (27) or bearing points form a rectilinear longitudinal row in a direction transverse to the slats (20).

8. The spring system as claimed in claim 7, wherein the supporting bodies (21) of a rectilinear longitudinal row are arranged on a longitudinal carrier (18, 19) of the carrying structure of the spring system, the longitudinal carrier running transversely to the slats (20).

9. The spring system as claimed in claim 8, wherein, as seen in plan view, the longitudinal carrier (18, 19) is arranged between the slat ends (31, 32).

10. The spring system as claimed in claim 1, wherein arranged on at least one of the slats (20) are stimulation elements (34) which have supporting surfaces (38) above a slat plane for resiliently supporting upholstery or a mattress or which serve for direct stimulation.

11. The spring system as claimed in claim 10, wherein the stimulation elements (21) are displaceable along a longitudinal slat direction.

12. The spring system as claimed in claim 1, wherein the slats (20) have arranged on them lateral guide elements (39) which are designed such that the upholstery or the mattresses butting against the spring system is/are blocked and/or limited in respect of movement in a longitudinal slat direction.

13. The spring system as claimed in claim 12, wherein the position of the lateral guide elements (39) is changeable relative to the slat in the longitudinal slat direction.

14. The spring system as claimed in claim 13, wherein the lateral guide elements (39) are formed by wholly or partially tiltable wing elements.

15. The spring system as claimed in claim 1, wherein a knitted fabric is positioned on the slats (20) and is connected thereto by a snap-in connection.

16. The spring system as claimed in claim 1, wherein the position of the supporting bodies (21), which support the slats (20), is changeable relative to the respective slat (20), and the supporting bodies (21) can be secured individually or jointly in their position in relation to the slat (20).

17. The spring system as claimed in claim 1, wherein the bearing points or bearing regions (27), on which the slats (20) are supported by the supporting bodies (31), are spaced apart from the slat ends (31, 32) by at least 5 cm.

18. The spring system as claimed in claim 1, wherein the snap-in connection is a clamping connection or clip connection.

19. A spring system for upholstery and/or mattresses of push-carriage seats, furniture for sitting on or lying on, the spring system having a plurality of successively spaced-apart resilient slats (20) and having supporting bodies (21) for supporting the slats directly or indirectly on a carrying structure, wherein bearing points or bearing regions (27) of the slats (20), on which the slats (20) are supported by the supporting bodies (21), are arranged exclusively between the slat ends (31, 32), and wherein arranged on at least one of the slats (20) are stimulation elements (34) which have supporting surfaces (38) above a slat plane for resiliently supporting upholstery or a mattress or which serve for direct stimulation.

20. The spring system as claimed in claim 19, wherein the stimulation elements (21) are displaceable along a longitudinal slat direction.

21. A spring system for upholstery and/or mattresses of push-carriage seats, furniture for sitting on or lying on, the spring system having a plurality of successively spaced-apart resilient slats (20) and having supporting bodies (21) for supporting the slats directly or indirectly on a carrying structure, wherein bearing points or bearing regions (27) of the slats (20), on which the slats (20) are supported by the supporting bodies (21), are arranged exclusively between the slat ends (31, 32), and wherein a knitted fabric is positioned on the slats (20) and is connected thereto by a snap-in connection.

* * * * *